US008640781B2

(12) United States Patent
Freyer

(10) Patent No.: US 8,640,781 B2
(45) Date of Patent: Feb. 4, 2014

(54) METHOD AND DEVICE FOR DEPLOYING A CABLE AND AN APPARATUS IN THE GROUND

(75) Inventor: Rune Freyer, Hafrsfjord (NO)

(73) Assignee: Fishbones AS (NO)

( * ) Notice: Subject to any disclaimer, the term of this patent is extended or adjusted under 35 U.S.C. 154(b) by 331 days.

(21) Appl. No.: 13/020,599

(22) Filed: Feb. 3, 2011

(65) Prior Publication Data

US 2012/0199368 A1 Aug. 9, 2012

(51) Int. Cl.
*E21B 19/08* (2006.01)
*E21B 7/18* (2006.01)

(52) U.S. Cl.
USPC ..... 166/385; 166/77.1; 175/77; 175/21; 175/424

(58) Field of Classification Search
USPC ..... 175/77, 19, 424, 21, 65; 166/385, 77.1
See application file for complete search history.

(56) References Cited

U.S. PATENT DOCUMENTS

| | | | | | |
|---|---|---|---|---|---|
| 2,198,016 | A | * | 4/1940 | Rogers et al. | 175/82 |
| 4,007,797 | A | * | 2/1977 | Jeter | 175/26 |
| 4,787,465 | A | * | 11/1988 | Dickinson et al. | 175/67 |
| 4,790,394 | A | * | 12/1988 | Dickinson et al. | 175/61 |
| 5,853,056 | A | * | 12/1998 | Landers | 175/424 |
| 2009/0057013 | A1 | * | 3/2009 | Gourley et al. | 175/19 |

FOREIGN PATENT DOCUMENTS

| | | | |
|---|---|---|---|
| EP | 2 098 679 | A1 | 9/2009 |
| EP | 2 098 679 | B1 | 11/2010 |
| GB | 2 370 303 | A | 6/2002 |
| GB | 2 370 303 | B | 6/2003 |
| WO | 99/60244 | A1 | 11/1999 |

* cited by examiner

*Primary Examiner* — Kenneth L Thompson
(74) *Attorney, Agent, or Firm* — Andrus Intellectual Property Law, LLP

(57) ABSTRACT

A method and device for deploying a cable and an apparatus in a ground formation having a motherbore, wherein the method comprises positioning a non-rotating drill pipe, a cable and an apparatus in a motherbore tubular; and drilling a lateral opening relatively the motherbore by displacing the drill pipe into the formation with the cable and apparatus attached.

14 Claims, 5 Drawing Sheets

METHOD AND DEVICE FOR DEPLOYING A CABLE AND AN APPARATUS IN THE GROUND

FIELD

There is provided a method of deploying a cable and an apparatus in the ground. More precisely there is provided method of deploying a cable and an apparatus in a ground formation having a motherbore. The invention also includes a device for practising the method.

BACKGROUND

Information about conditions and events in the ground may be of great value in relation to processes undertaken in the ground. For instance when trying to understand processes in a petroleum reservoir with the purpose of optimising the production or stimulation operations, it is vital to know physical conditions in the reservoir. The physical conditions may include pressure, temperature, location of seismic events, electric conductivity and other conditions that are well known to a person skilled in the art.

Some of these conditions may be retrieved with sufficient accuracy from the main wellbore, while others should be recovered from the formation away from the main wellbore. As in the case of seismic events, it is advantageous to have at least three geophones spaced out in the ground in order be able to interpolate where the seismic events occurred.

From GB 2370303 it is known to position sensors in abandoned boreholes. The deployment of equipment in such abandoned wellbores are difficult, because it is not deployed with the final completion pipe through the wellbore and connecting the wire to surface will be difficult.

This is particularly so in the event of registering seismic events as the attenuation rate in the formation of signals originating from such events is relatively large, and geophones are sensitive to unwanted noise, for instance from a flowing fluid such as fracturing fluid and proppant particles.

SUMMARY

The purpose of the invention is to overcome or reduce at least one of the disadvantages of the prior art.

The purpose is achieved according to the invention by the features as disclosed in the description below and in the following patent claims.

There is provided a method of deploying a cable and an apparatus in a ground formation having a motherbore wherein the method includes:

positioning a non-rotating drill pipe, a cable and an apparatus in a motherbore tubular;

drilling a lateral opening relatively the motherbore by displacing the drill pipe into the formation with the cable and apparatus attached.

The term "apparatus" is to be understood in the widest sense. For instance the apparatus may be a sensor, a valve, an actuator or combination thereof. The apparatus may include continuous or discrete items along the cable, for instance heating elements or seismic sensors.

Thus the apparatus may be put at a desired position in the formation. The apparatus as well as the cable may be connected to and follow a drill pipe of the kind described in EP-patent 2098679 or WO 99/60244, herby included by reference, when the drill pipe is displaced into the formation.

The method may include drilling the lateral opening by use of at least one of the methods: pressure jetting with a fluid, pressure jetting with a fluid containing abrasive particles, a drill bit connected to a drill motor or a rotating drill string inside a non-rotating drill pipe.

The method may include positioning the cable at least in one of the following positions: outside or inside the drill pipe, in a recess outside or inside the drill pipe or in a bore in a wall of the drill pipe.

The method may include feeding the cable from a store, for instance in the form of a reel or other form of accumulated cable, in the motherbore as the drill pipe is displaced into the formation. The method may include attaching the cable to a head of the drill pipe.

The method may include attaching the cablestore in the drill pipe and feed the cable from the cablestore as the drill pipe is displaced into the formation.

The method may include retrieving the drill pipe and leaving the cable and sensor in the lateral opening.

The method may include chemically dissolving the drill pipe from the lateral opening for instance by use of a reactive solution.

The method may include inserting a body in the drill pipe that changes form when the drill pipe is chemically removed.

Thus the cable and possibly the apparatus may be mechanically biased by the body towards the formation in the lateral opening.

The method may include filling at least a part of the lateral opening with particulate material. Such material may assist in reducing signal interference between the lateral and the motherbore.

The method may include disconnecting the drill pipe chemically, electrically or hydraulically from the motherbore tubular. This may be advantageous in order to isolate the drill pipe with the apparatus from the motherbore tubular.

The method may include isolating the drill pipe from the motherbore by use of at least one of a group including swellable elastomeric packer, cement or other settable fluid. The drill pipe may thus be hydraulically isolated after the lateral opening is completed. This may further isolate the sensor from noise and other physical conditions in the motherbore or the motherbore tubular.

The method may include choosing the cable from one or more items in a group including electrical cable, electrical heating cable, fibre optical cable, hydraulic cable or combinations thereof.

The method may be carried out by utilizing a device for deploying a cable and a sensor in a ground formation having a motherbore and a motherbore tubular, and where a non-rotating drill pipe, a cable and an apparatus initially positioned in the motherbore tubular, together are displaceable while drilling a lateral opening relatively the motherbore into the formation.

The cable may be connected to an apparatus from a group including, but not limited to a sensor, a valve and an actuator.

The method and device according to the invention render it possible to position a cable connected apparatus in a chosen position in the formation relative the motherbore and further isolate the apparatus at least to a certain extent from physical conditions in the motherbore.

BRIEF DESCRIPTION OF THE DRAWINGS

Below, an example of a preferred method and device is explained under reference to the enclosed drawings, where.

DETAILED DESCRIPTION OF THE DRAWINGS

Figure 1:
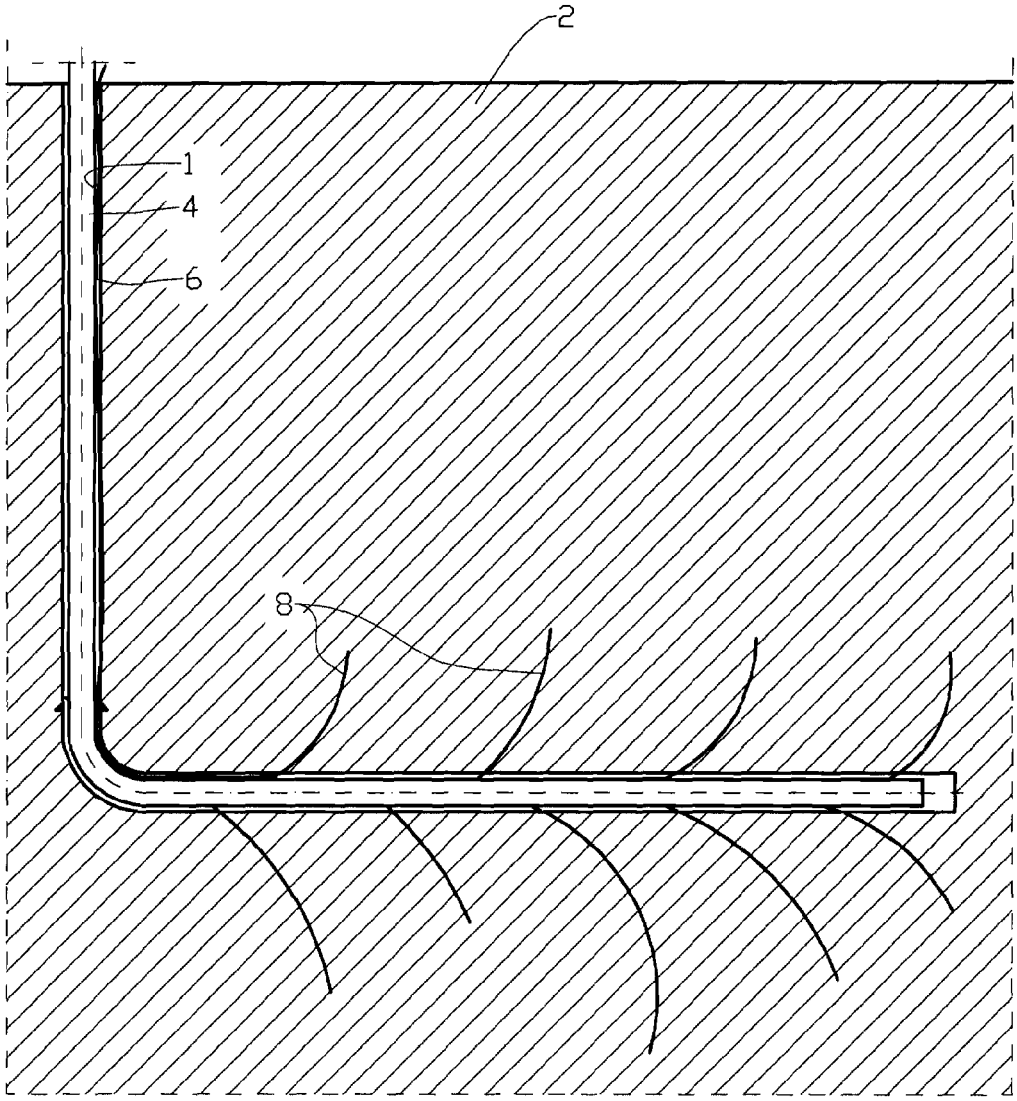
FIG. 1 simplified shows a motherbore in a formation where lateral openings are made into the formation from a motherbore tubular.

On the drawings the reference number 1 denotes a motherbore in a ground formation 2 where a motherbore tubular 4 is positioned in the motherbore 1. In FIG. 1 a main cable 6 is positioned outside the motherbore tubular 4 while drill pipes 8 extends into the formation 2 from the motherbore tubular 4.

Below, when referring to all drill pipes, reference numeral 8 is used. When referring to an individual drill pipe reference 8*a* is used for a first drill pipe and reference 8*b* for a second drill pipe.

Figure 2:
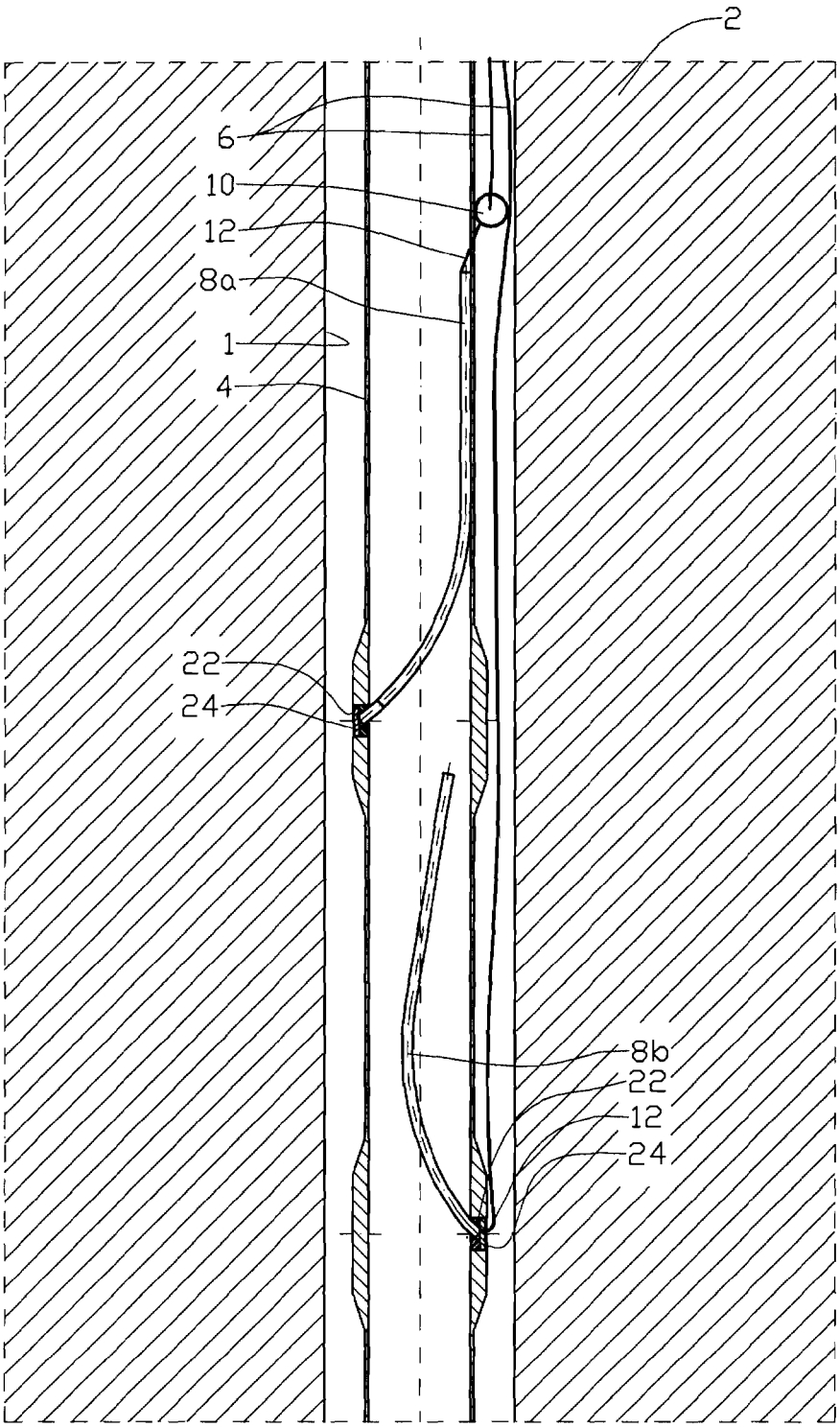
FIG. 2 shows at a larger scale a part of the motherbore where relatively narrow drill pipes are positioned inside the motherbore tubular.

Referring now to FIG. 2 that shows a first drill pipe 8*a* and a second drill pipe 8*b* at an initial stage inside the motherbore tubular 4, the main cable 6 is connected to a cable store 10 that is fixed to the motherbore tubular 4. A cable 12 of the cable store 10 is connected to an apparatus 14 in a head 16 of the first drill pipe 8*a*, see for instance FIG. 7, where the cable 12 is positioned outside a drill pipe wall 20.

Figure 5:
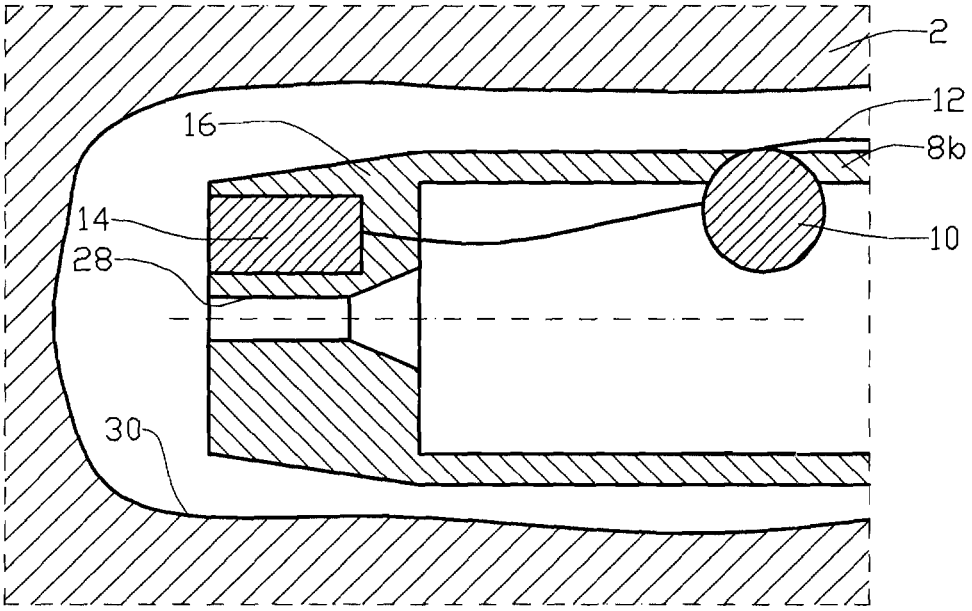
FIG. 5 shows the drill head party of FIG. 4, but here the cable is stored in a cable store at the head, and where the cable is running outside the drill pipe.

A main cable 6 is connected to a cable 12 of the second drill pipe 8*b*. The cable 12 of the second drill pipe 8*b* is connected to a cable store 10 positioned in the second drill pipe 8*b* as shown in FIG. 5.

The method of positioning the drill pipes 8 in the motherbore tubular 4 and displacing the drill pipes 8 into the formation 2 is explained in EP-patent 2098679. Each of the drill pipes 8 may initially be positioned at a wall opening 22 possibly having a burst disk 24.

Figure 3:
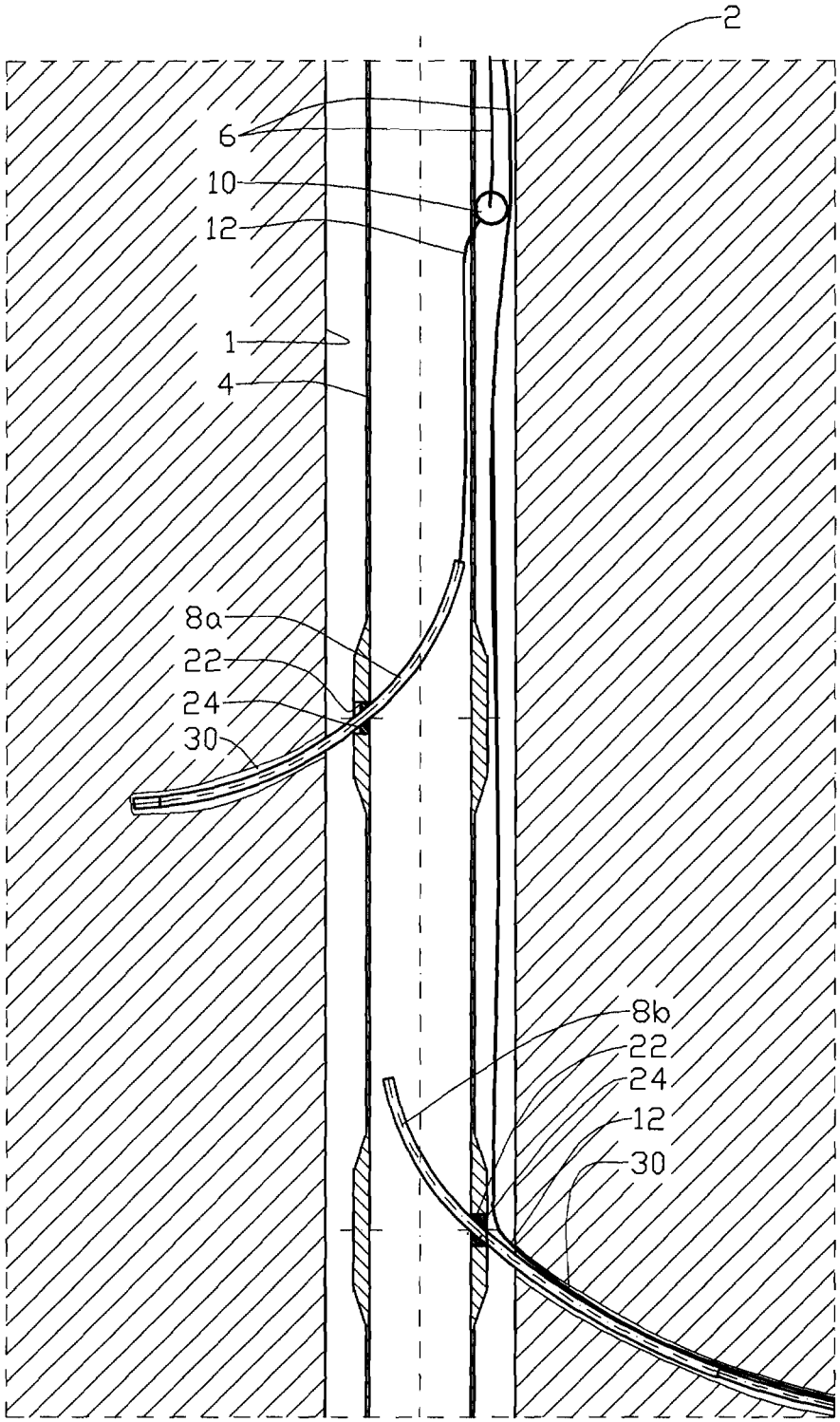
FIG. 3 shows the same as in FIG. 2 but here the drill pipes are positioned partly into the formation.

In FIG. 3 the first and second drill pipes 8*a*, 8*b* are shown in a position partly inside the formation 2. The cable 12 is fed from the cable store 10 on the motherbore tubular 4 when the first drill pipe 8*a* is penetrating the formation 2. In the case of the second drill pipe 8*b* the cable 12 is fed from the cable store 10 of the second drill pipe 8*b* as the second drill pipe 8*b* penetrates into the formation 2.

The apparatus 14 is then positioned at a lateral distance from the motherbore 1 in the formation 2.

Figure 4:
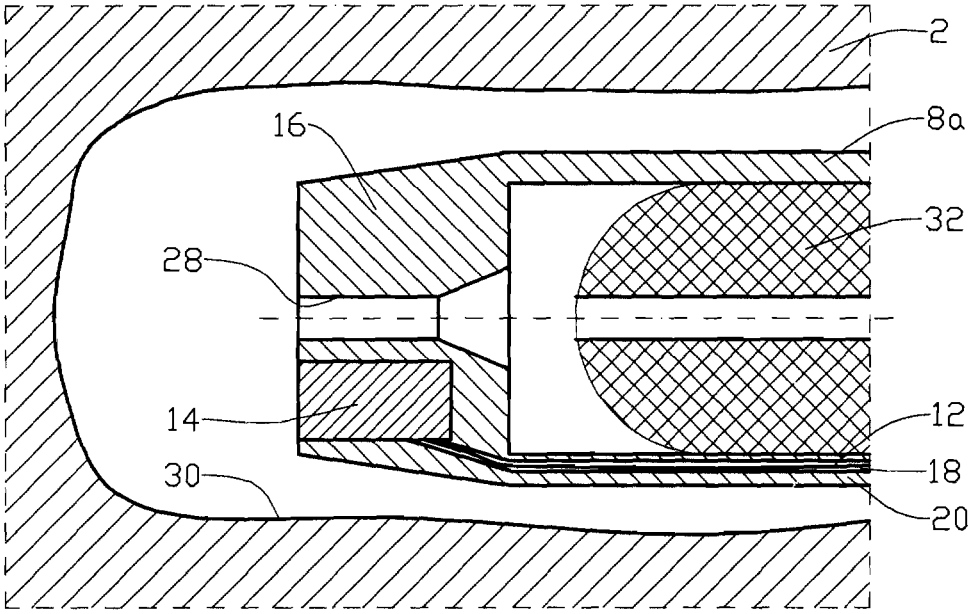
FIG. 4 shows at a still larger scale a drill head party for fluid drilling having an apparatus and where a cable is positioned in a wall bore of the drill pipe.

FIG. 4 shows the head 16 of a drill pipe, here the first drill pipe 8*a*. The head 16 has a nozzle 28 where fluid is discharge for drilling a lateral opening 30 into the formation 2.

A body 32 is positioned inside the first drill pipe 8*a*. The body 32 will change shape, such as expand, if the first drill pipe 8*a* is dissolved. The body 32 may thus bias the cable 12 and the apparatus 14 towards the formation 2.

A cable store 10 is positioned in the second drill pipe 8*b*.

Figure 6:
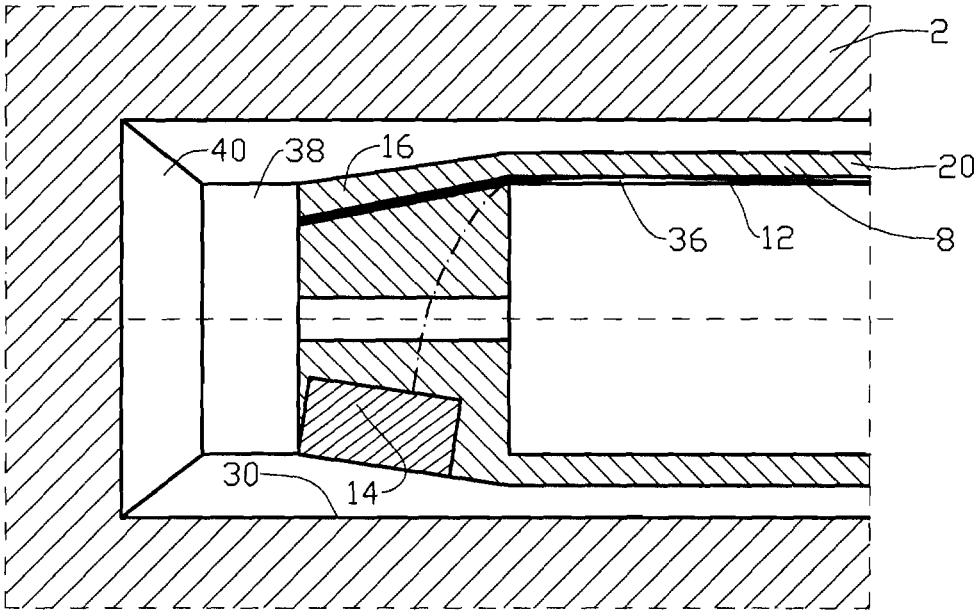
FIG. 6 shows the drill head party of FIG. 4, but here the drill head is equipped with a drill motor and a drill bit.

In FIG. 6 the cable 12 is positioned in a recess 36 on the inside of the drill pipe wall 20. The cable 12 is in addition to the apparatus 14 connected to a motor 38 for a drill bit 40.

Figure 7:
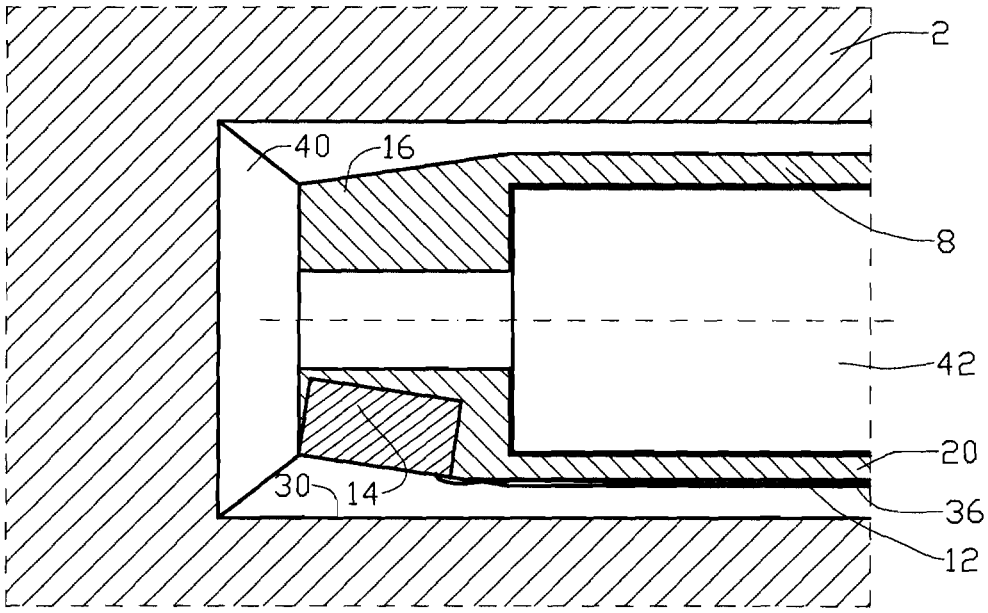
FIG. 7 shows the drill head party of FIG. 6, but here the drill bit is driven by a rotating drill string inside the non-rotating drill pipe.

In FIG. 7 the cable 12 is positioned in a recess 36 on the outside of the drill pipe wall 20. The drill bit 20 is driven by a drill string 42 inside the drill pipe 8.

What is claimed is:

1. A method of deploying a cable and an apparatus in a ground formation having a motherbore, the method comprising:

positioning a non-rotating drill pipe, a cable and an apparatus in a motherbore tubular;

drilling a lateral opening relatively the motherbore by displacing the drill pipe into the formation with the cable and apparatus attached;

positioning the cable at least in one of the following positions: outside or inside the drill pipe, in a recess outside or inside the drill pipe or in a wall of the drill pipe; and feeding the cable from a store in the motherbore tubular as the drill pipe is displaced into the formation.

2. A method according to claim 1, comprising drilling the lateral opening by use of at least one of the methods: pressure jetting with a fluid, pressure jetting with a fluid containing abrasive particles, a drill bit connected to a drill motor or a rotating drill string, positioned inside the non-rotating drill pipe.

3. A method according to claim 1, comprising positioning the cable at least in one of the following positions: outside or inside the drill pipe, in a recess outside or inside the drill pipe or in a bore in a wall of the drill pipe.

4. A method according to claim 1, comprising attaching the cable to a head of the drill pipe.

5. A method according to claim 1 comprising disconnecting the drill pipe chemically, electrically or hydraulically from the motherbore tubular.

6. A method according to claim 1 comprising choosing the cable from one or more items in a group including electrical cable, electrical heating cable, fibre optical cable, hydraulic cable or combinations thereof.

7. A method according to claim 1 comprising choosing the apparatus from a group including a sensor, a valve and an actuator.

8. A method according to claim 1 comprising isolating the drill pipe from the motherbore by use of at least one item from a group including swellable elastomeric packer, cement or other settable fluid.

9. A method of deploying a cable and an apparatus in a ground formation having a motherbore, the method comprising:

positioning a non-rotating drill pipe, a cable and an apparatus in a mother tubular;

drilling a lateral opening relatively the motherbore by displacing the drill pipe into the formation with the cable and apparatus attached; and attaching a cable store to a head of the drill pipe and feeding cable from the head as the drill pipe is displaced into the formation.

10. A method of deploying a cable and an apparatus in a ground formation having a motherbore, the method comprising:

positioning a non-rotating drill pipe, a cable and an apparatus in a motherbore tubular;

drilling a lateral opening relatively the motherbore by displacing the drill pipe into the formation with the cable and apparatus attached; and retrieving the drill pipe and leaving the cable and apparatus in a lateral opening.

11. A method of deploying a cable and an apparatus in a ground formation having a motherbore, the method comprising:

positioning a non-rotating drill pipe, a cable as apparatus in a motherbore tublar;

drilling a lateral opening relatively the motherbore by displacing the drill pipe into the formation with the cable and apparatus attached; and chemically dissolving the drill pipe from a lateral opening.

12. A method according to claim 11, comprising dissolving the drill pipe chemically by use of reactive solution.

13. A method according to claim 11 comprising, inserting a body in the drill pipe that changes form when the drill pipe is chemically removed.

14. A method according to claim 11 comprising filling at least a part of the lateral opening with particulate material.

* * * * *